US006793211B2

(12) United States Patent
Müller

(10) Patent No.: US 6,793,211 B2
(45) Date of Patent: Sep. 21, 2004

(54) POCKET WHEEL FEEDING DEVICE

(75) Inventor: Hans Müller, Zofingen (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 10/160,373

(22) Filed: May 31, 2002

(65) Prior Publication Data

US 2003/0047867 A1 Mar. 13, 2003

Related U.S. Application Data

(63) Continuation of application No. 09/465,953, filed on Dec. 17, 1999, now abandoned.

(30) Foreign Application Priority Data

Dec. 28, 1998 (EP) ..... 98811270

(51) Int. Cl.[7] ..... B65H 39/02
(52) U.S. Cl. ..... 270/52.27; 271/315
(58) Field of Search ..... 271/315; 270/52.14, 270/52.2, 52.21, 52.22, 52.26, 52.27

(56) References Cited

U.S. PATENT DOCUMENTS 3,420,516 A * 1/1969 Guggisberg ..... 270/52.2
4,133,521 A * 1/1979 Muller ..... 270/52.2
4,398,710 A * 8/1983 Hansch ..... 270/52.23
4,477,067 A * 10/1984 Wise ..... 270/52.2
4,491,311 A * 1/1985 Glanzmann ..... 270/52.27
4,801,132 A * 1/1989 Reist ..... 270/52.22
4,989,850 A * 2/1991 Weller ..... 270/1.02
5,067,700 A * 11/1991 Dick ..... 270/52.29
5,277,413 A * 1/1994 Boss ..... 270/52.3
5,758,871 A * 6/1998 Schlough ..... 270/52.27
6,082,724 A * 7/2000 Kahlig et al. ..... 270/52.14

* cited by examiner

*Primary Examiner*—Patrick Mackey
(74) *Attorney, Agent, or Firm*—Friedrich Kueffner

(57) ABSTRACT

A feeder for collecting printed sheets in an astride position includes a pulling-off drum which has at the circumference thereof gripping members for pulling off printed sheets stacked in a magazine. The feeder further includes a unit for conveying the printed sheets with an open side facing forward into an opening device. The opening device is arranged in front of a collecting device. The unit arranged between the pulling-off drum and the opening device is formed by a pocket wheel or a pocket chain provided with revolving pockets for receiving the printed sheets which are supplied with their folds facing forwardly, and a conveying member arranged in front of the pockets.

8 Claims, 5 Drawing Sheets

POCKET WHEEL FEEDING DEVICE

This application is a continuation application of U.S. patent application Ser. No. 09/465,953, filed Dec. 17, 1999, now abandoned.

BACKGROUND OF THE INVENTION

1. Field of the Invention

The present invention relates to a feeder for collecting printed sheets in an astride position. The feeder includes a pulling-off drum which has at the circumference thereof gripping means for pulling off printed sheets stacked in a magazine. The feeder further includes means for conveying the printed sheets with an open side facing forward into an opening device. The opening device is arranged in front of a collecting device.

2. Description of the Related Art

Feeders of the above-described type have a pulling-off drum which has at the circumference thereof gripping members which serve to pull the individual sheets from a stack and to convey the sheets to opening drums. The pulling-off drum grasps the sheets at their closed backs and conveys the sheets to a stationary pocket arranged at the circumference of the drum, wherein the sheets come to rest against a stop in the pocket. Additional gripping means are provided for grasping the sheets at their open ends and for pulling the sheets against the direction of rotation of the drum out of the pocket and to convey the sheets to the opening drums where they are opened and placed on the collector chain.

In the feeder of this type, a precise contact or impact of the sheets at the stationary stops of the pocket is no longer ensured at very high speeds because the sheets can no longer come to rest in the pocket. When the sheets are not precisely placed in the pocket, they cannot be exactly grasped with the additional gripping means at the open ends and can subsequently not be safely opened in the opening drums. This means that a further increase of the output is not possible.

SUMMARY OF THE INVENTION

Therefore, it is the primary object of the present invention to provide a feeder of the above-described type which ensures a high output and which can still be manufactured inexpensively and operates safely.

In accordance with the present invention, the means arranged between the pulling-off drum and the opening device is formed by a pocket wheel or a pocket chain provided with revolving pockets for receiving the printed sheets which are supplied with their folds facing forwardly, and a conveying member arranged in front of the pockets.

As a result of the configuration according to the present invention, the use of several pockets makes it possible that the sheets can remain in the pockets for a much longer time. Consequently, there is enough time for the sheets to come to rest in the pockets and, if necessary, for the sheets to be precisely aligned. Thus, the sheets which have come to rest in the pockets can be conveyed precisely to the opening drums even at higher processing speeds.

Another advantage of the feeder according to the present invention is seen in the fact that sheets can be supplied with several pulling-off drums. In that case, one of the pulling-off drums can be used, for example, as a repair element or in a 2:1 operation for facilitating the manual feeding by several persons. Also possible is a selective production in which different sheets are conveyed in a controlled manner from several stacks. In addition, one of the pulling-off drums can be used for automatic feeding and another pulling-off drum can be used for a manual reinsertion of the sheets.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
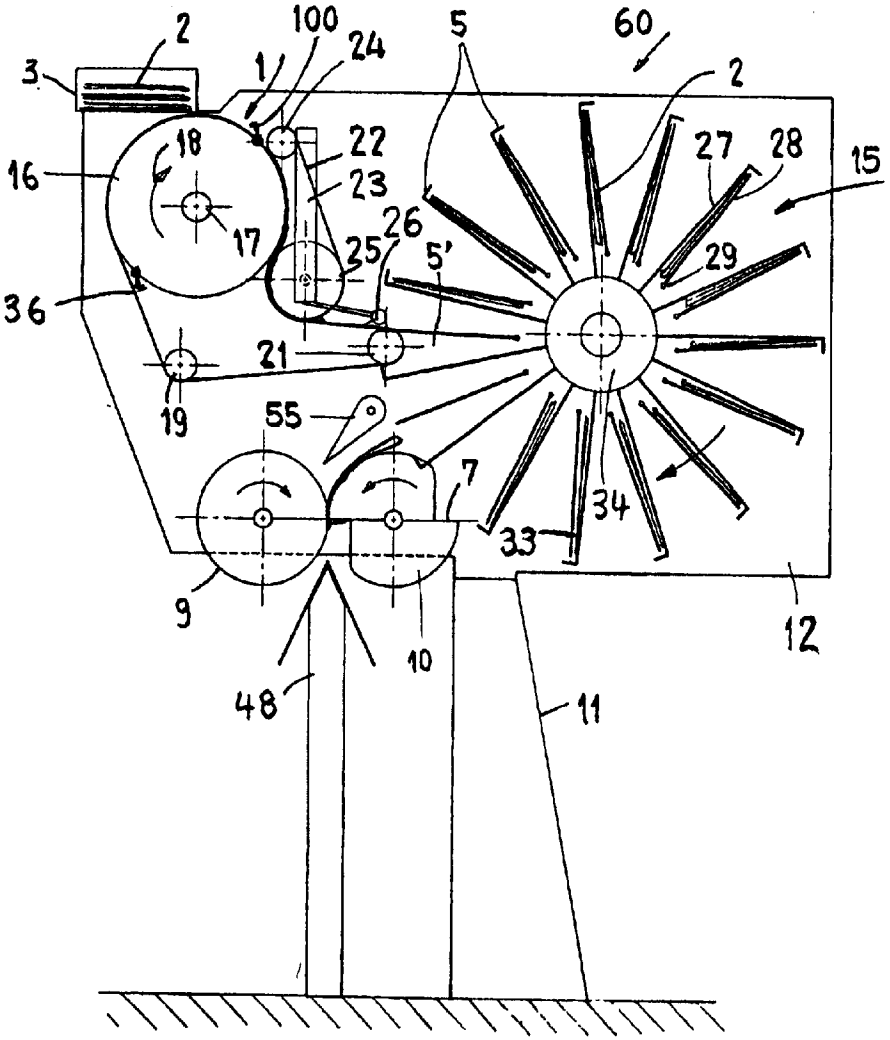
FIG. 1 is a schematic elevational view of a feeder according to the invention.
Figure 2:
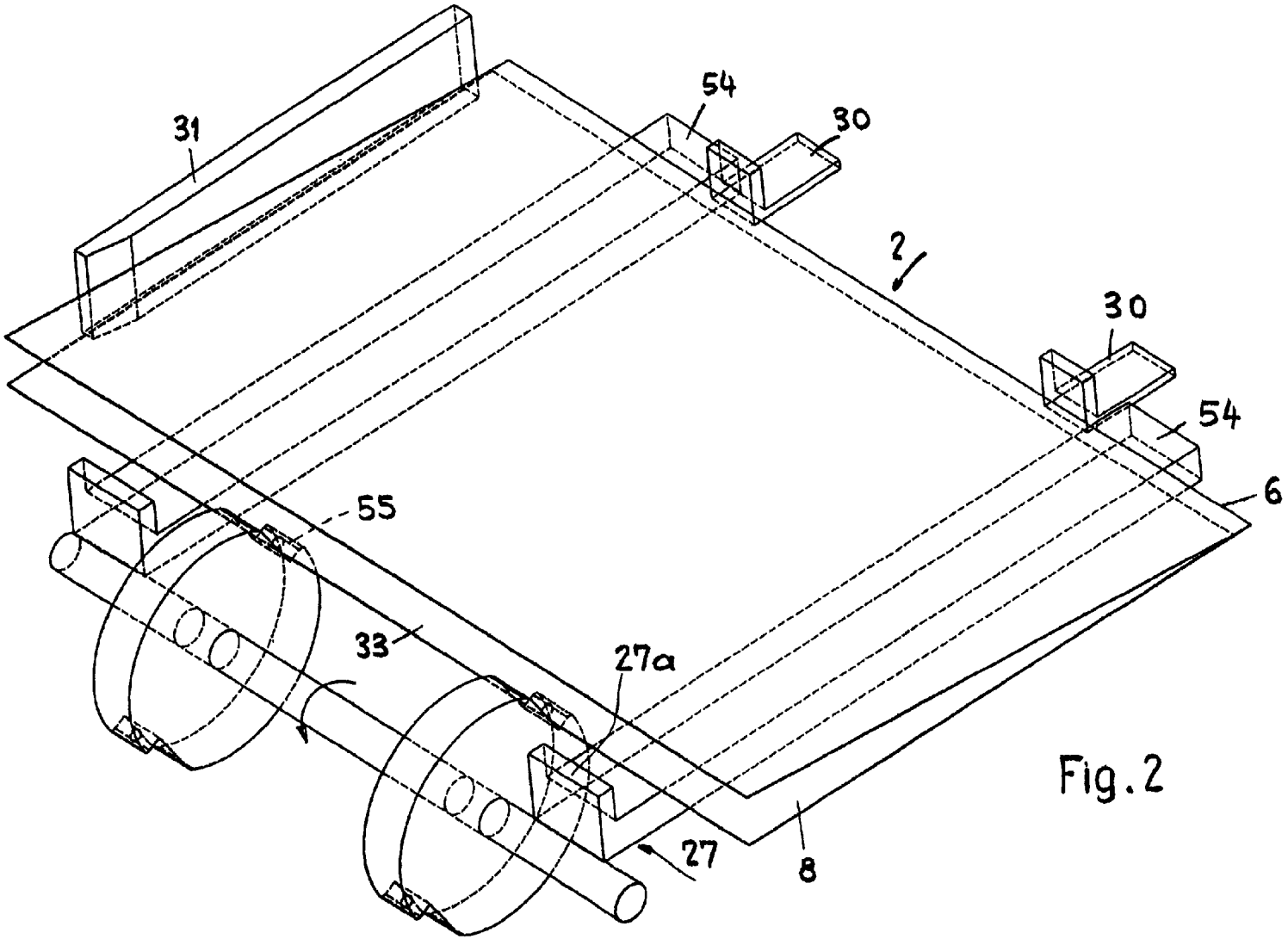
FIG. 2 is a schematic partial view of a pocket with a sheet placed in the pocket.

The feeder 60 illustrated in FIG. 1 includes a machine frame 11 with two support plates 12. Mounted on the support plates 12 are a pulling-off drum 1, a pocket wheel 15 and two opening drums 9 and 10. A stack 3 with printed sheets 2 is located above the pulling-off drum 1. The printed sheets 2 are individually pulled off by means of the pulling-off drum 1 at the bottom side of the stack 3. The sheets 2 preferably are sheets which, as shown in FIG. 2, have a fold 6 at one end and a gripping edge 33 at the opposite open end 8. The sheets 2 of the stack 3 are placed by means of the feeder 60 individually on a conventional collector chain 48 or a collector saddle and are conveyed to additional processing units, for example, a stitching machine, not shown.

The pulling-off drum 1 is composed of a drum 16 with a shaft 17, wherein the drum 16 has at the circumference thereof gripping means 100 for grasping each sheet 2 of the stack 3 in the vicinity of the fold 6 of the sheet 2. These gripping means are, for example, suction devices and gripping devices.

The drum 16 rotates in the direction of the arrow 18 and the sheets 2 grasped by the gripping means are conveyed between belts 36 and 22 at first essentially vertically downwardly and then around a roller 25 essentially horizontally towards the pocket wheel 15. After the transfer of the sheets into the belts, the gripping means once again release each sheet 2. As shown in FIG. 1, the belt 36 is placed around the drum 6 as well as around two guide rollers 19 and 21. The endless belt 36 may be composed of several laterally offset partial belts. The belt 22 is placed around two rollers 24 and 25 which are mounted on a vertical support member 23. The belt 22 may also be composed of laterally offset partial belts. Hinged to the lower end of the support member 23 is a guide roller 26 which cooperates with the guide roller 21 for guiding the sheets 2. The sheets 2 are placed between these two drums 21 and 26 in FIG. 1 with the fold 6 facing forwardly approximately horizontally into an open pocket 5' of the pocket wheel 15, as schematically shown in FIG. 3.

The pocket wheel 15 has a plurality of radially extending pockets 5 which are attached to a hub 34. However, the radial direction of the pockets 5 is not absolutely required. Also conceivable is an embodiment in which the pockets 5 form an angle with the radial direction. As can be seen in FIG. 3, the pockets 5 preferably include a rear portion 27 rigidly connected to the hub 34 and a pivotable front portion 28. For example, as illustrated in FIG. 3, the front portion 28 can be connected to the hub 34 through a hinge 32 and can be pivoted in the directions of the double arrow 52 by means of a control cam, not shown.

Figure 3:
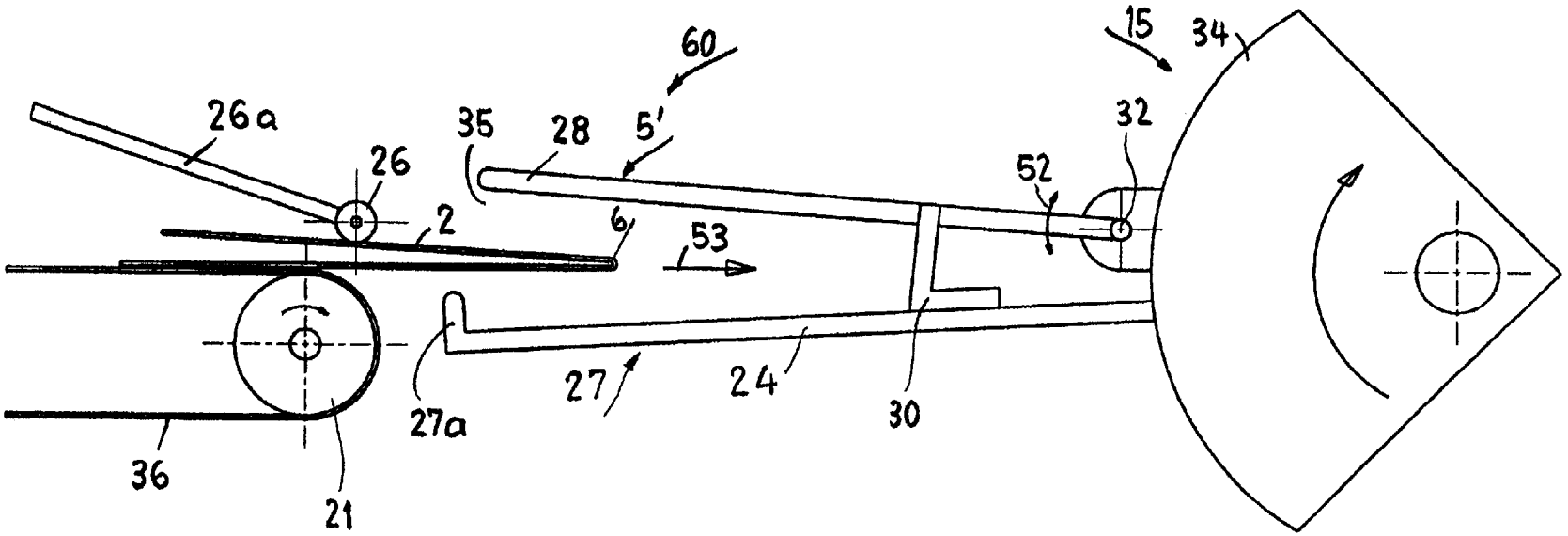
FIG. 3 is a partial sectional view showing the insertion of a sheet into a pocket.

In the position illustrated in FIG. 3, the front portion 28 is pivoted away from the rear portion 27 in such a way that the pocket 5' has a front opening 35 through which the sheets 2 can be inserted in the direction of the arrow 53 against a stop 30. The stop 30 is preferably radially adjustable for adjusting the pocket to different sizes of the sheets. When the sheet 2 is inserted, it impinges with the fold 6 against the stop 30. Located opposite the stop 30 at the radially outer end of the rear portion 27 is an upwardly protruding part 27*a* which supports the sheet 2 at the open end 8 as seen in FIG. 2. As illustrated in FIG. 2, the rear portion 27 is formed by several radially extending arms 54. Of course, it would also be possible to construct the rear portion 27 flat and the corresponding front portion 8 with a part 27*a* protruding beyond the end edge of the rear portion 27 which, when the pocket 5 is closed, prevents the sheet 2 from escaping out of the pocket 5.

As illustrated in FIG. 2, for laterally aligning the sheets 2, a guide member 31 is arranged laterally for precisely aligning the sheets 2 when they are inserted. The guide member 32 may be stationary or forwardly and backwardly oscillating. Two such guide members 31 can also be arranged at opposite sides. Also in this case, the guide members 31 are preferably adjustable for adjusting to different sheet sizes. Preferably, all pockets 5 are constructed equally.

As illustrated in FIG. 1, the pocket wheel 15 is driven in the clockwise direction. In all pockets 5 the front portion 28 is controlled in such a way that, after the sheet 2 has been inserted, the front portion 28 is pivoted towards the rear portion 27 and the pocket 5 is closed in this manner. As a result, the inserted sheet 2 is precisely positioned and held in the pocket 5 and can come to rest as the pocket wheel 15 continues to rotate in the clockwise direction. It is essential that the sheet 2 is securely guided and supported after being pulled off from the stack 3 until being placed in the pocket 5'.

The inserted sheets 2 are individually removed from the pockets 5 approximately in the 8 o'clock position of the pocket wheel by means of an opening drum 10. The dwell time of the sheets 2 between the insertion and the removal is a multiple of the feeding cycle. Consequently, the dwell time is relatively long and certainly sufficiently long for allowing the sheets 2 to come to rest. For removing the sheets 2, the pockets 5 are opened in the area of the opening drums 9 and 10 by pivoting the respective front portion 28 away from the rear portion 27. The sheets 2 are grasped by means of a radially extending shoulder 7 of the opening wheel 10. The sheet 2 is grasped at the gripping edge 33 thereof in the conventional manner, for example, by means of schematically indicated suction devices 55 or grippers, and are guided between the two opening drums 9 and 10. The sheets 2 are guided by a guide member 55 arranged above the opening drum 10. The two opening drums 9 and 10 open the grasped sheet 2 and place it in the conventional manner on the collector chain 48.

Figure 4:
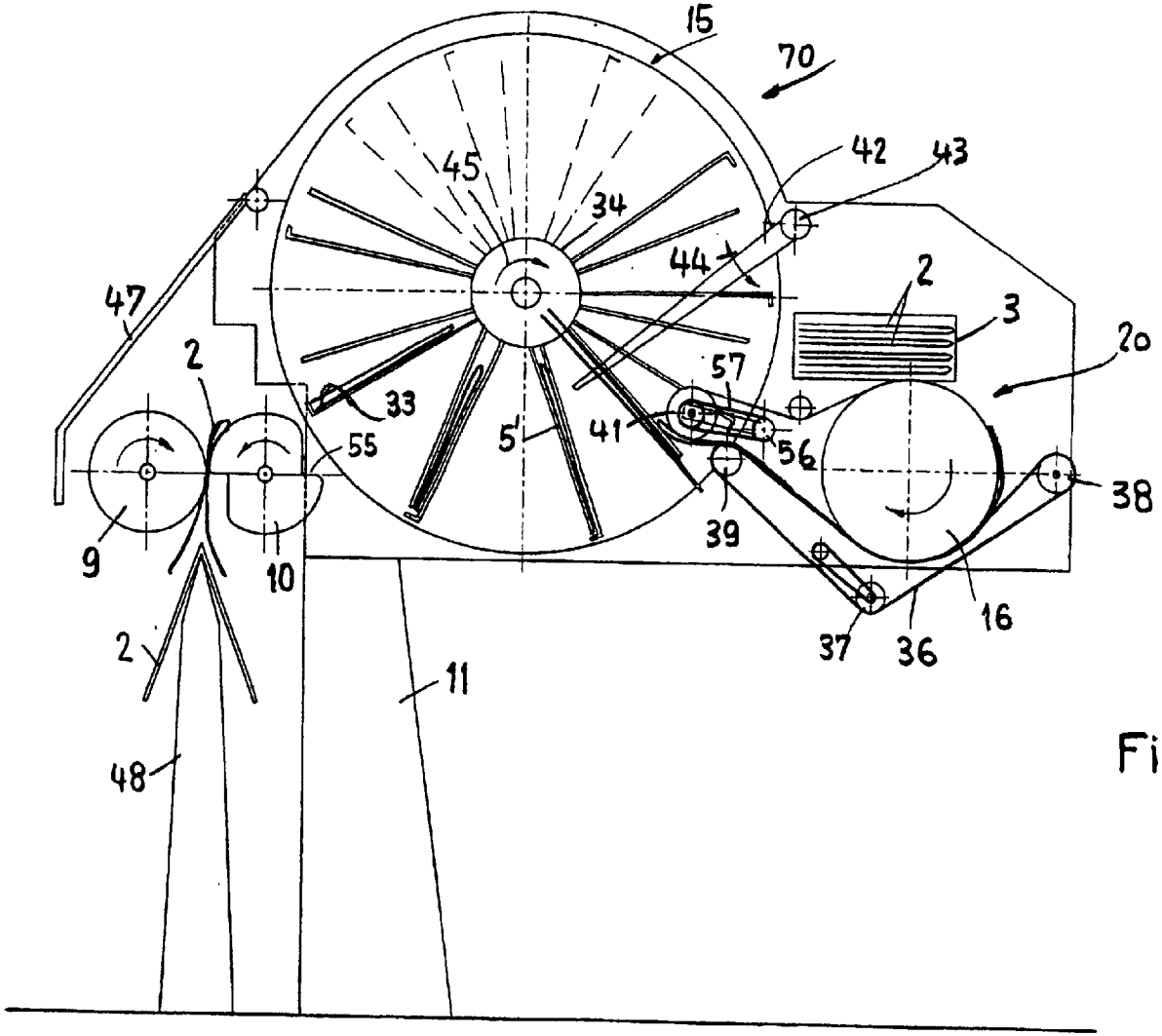
FIG. 4 is a schematic elevational view of another embodiment of the feeder according to the invention.

The feeder 70 illustrated in FIG. 4 also includes a pocket wheel 15 which is driven in the direction of the arrow 45 in the clockwise direction. However, feeding of the pockets 5 takes place in this case with a pulling-off drum 20 in an upwardly inclined direction. The pulling-off drum 20 removes the sheets 2 also from a stack 3 which is arranged above the drum 16. The sheets 2 pulled off from the stack 3 are guided at the circumference of the drum 16 by a belt 36 which is placed around a drive roller 37, a guide roller 38 and a pressure roller 39. The belt 36 can also be composed of partial belts. Arranged above the roller 39 is an additional belt 57 which is placed around a drive roller 56 and about a guide roller 41. The sheets 2 travel on the belt 36 between the roller 39 and the belt 57 and are inserted into a pocket 5' with the fold 6 facing forwardly. At least one arm 42 protruding into the pocket wheel 15 forms an upper stop for the sheets 2 in the pocket 5'. This arm 42 is pivotable about a hinge 43 in the directions of the arrow 44. This pivoting makes it possible to adjust the stop in an infinitely variable manner to adjust to different sheet sizes. Also provided may be lateral parts 31 which laterally center the sheets 2 when they are inserted into the pocket 5'. As illustrated in FIG. 4, when the sheet 2 is inserted into the pocket 5', the pocket 5' is inclined downwardly. For example, the angle 57 relative to the horizontal is about 40°.

When the pocket wheel rotates further, the front portion 28 is pivoted as explained above and the pocket 5' is closed as a result. Approximately when reaching the 8 o'clock position, the pocket 5' is once again opened and, as explained above, the sheet 2 is removed by means of the two opening drums 9 and 10 from the pocket 5', is opened and placed on the collector chain 48.

In the feeders 60 and 70, the sheets 2 are removed from a single stack 3 and supplied to the pockets 5. However, more than two stacks 3 can be provided at the circumference of the pocket wheel 15 and the corresponding number of pulling-off drums 1 or 20 may be provided. The stacks 3 may contain sheets 2 of equal or unequal sizes. Also conceivable is an embodiment in which one of the pulling-off drums 1 or 20 is used for a manual reinsertion or feeding of sheets. One of the pulling-off drums may also be used as a repair element. Moreover, when several pulling-off drums are provided, manual feeding by several persons is made possible.

Figure 5:
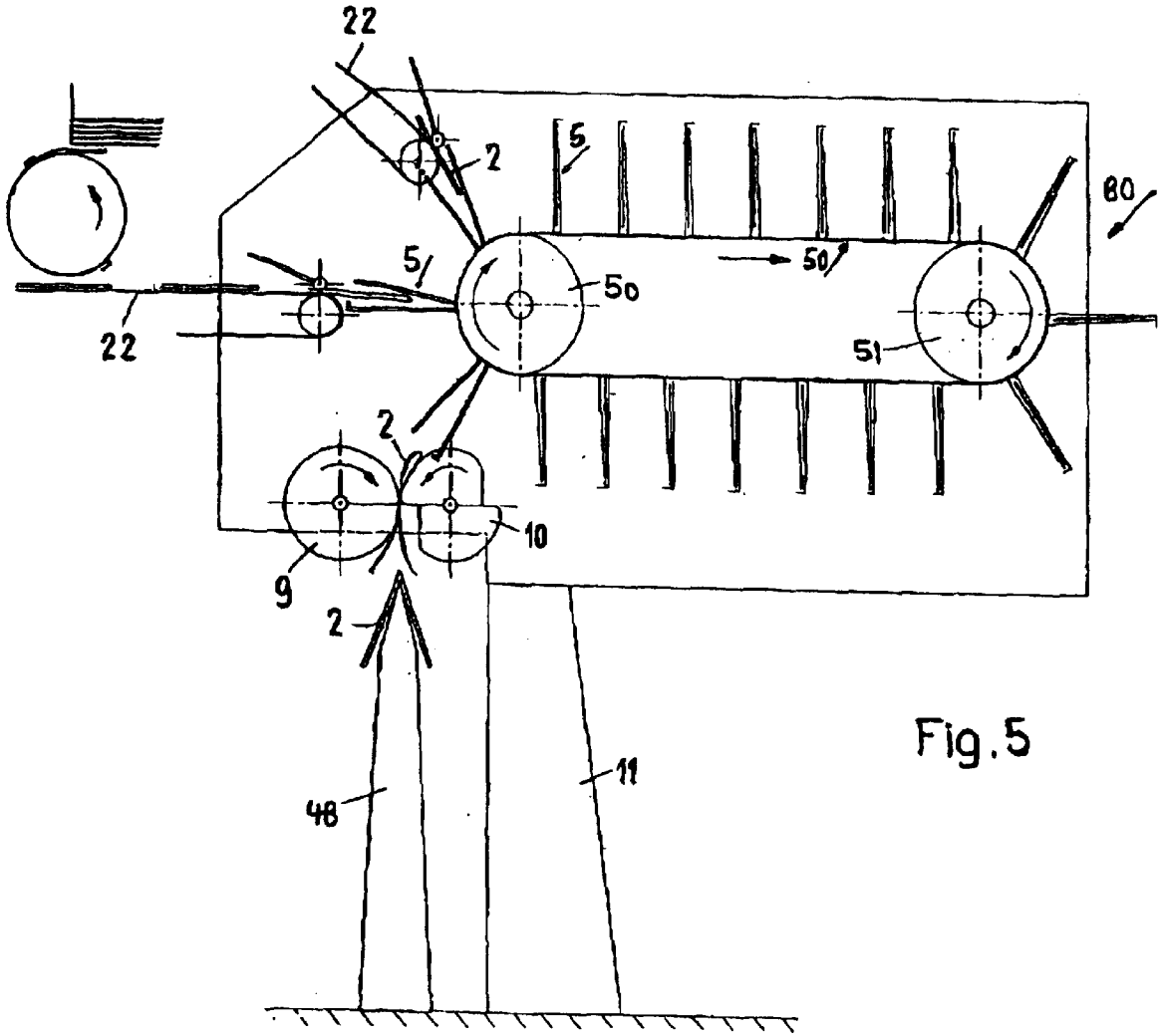
FIG. 5 is a schematic elevational view of yet another embodiment of the feeder according to the invention.

FIG. 5 of the drawing shows a feeder 80 which has a pocket chain 50 instead of a pocket wheel 15. This endless pocket chain 50 is placed around a drive wheel 51 and a guide wheel 50. The pocket chain 50 has at regular intervals pockets 5 which are constructed as explained above and to which the sheets are fed obliquely from above by means of pulling-off drums 1 and 1'. Feeding is carried out as described above in connection with FIG. 3. The removal of the sheets 2 also takes place as described above by means of opening drums 9 and 10. It is also essential in this feeder 80 that the dwell time of the sheets 2 in the pockets 5 is a multiple of the feeding cycle and, thus, the sheets 2 can be aligned if necessary in a precise position and sufficient time remains for allowing the sheets to come to rest. Even at high processing speeds, it is possible in this feeder to convey the sheets 2 which have been positioned and come to rest in the pockets 5 to the opening drums 9 and 10 and to open the sheets 2.

The invention is not limited by the embodiments described above which are presented as examples only but can be modified in various ways within the scope of protection defined by the appended patent claims.

I claim:

1. A feeder for collecting printed sheets in an astride position, the feeder comprising at least one rotating pulling-off drum with gripping means mounted at a circumference thereof for pulling off printed sheets stacked in a magazine, a stationary opening device having two opening drums;

conveying means for conveying the printed sheets with an open side facing forwardly to the opening device, and a collecting device downstream of the opening device, further comprising a pocket wheel or a pocket chain mounted between the pulling-off drum and the opening device, wherein the pocket wheel or pocket chain comprises revolving pockets for receiving the printed sheets with a fold thereof facing forwardly, the opening device being in operative conveying connection with the pockets downstream of the pocket wheel or pocket chain, and a conveying device between the pulling-off drum and the pocket wheel or pocket chain, wherein the pockets have a receiving opening at a circumference of the wheel, wherein the pockets are configured to be opened for receiving and for removing a sheet, further comprising adjustable means for aligning the sheets in the pockets, wherein the means for aligning the sheets are comprised of elements which are stationary relative to the pockets.

2. The feeder according to claim 1, wherein the conveying means is configured such that a dwell time of the sheets in the pockets is substantially longer than a pulling-off cycle of the pulling-off drum.

3. The feeder according to claim 1, wherein the pockets extend at least approximately radially relative to a hub of the wheel.

4. The feeder according to claim 1, wherein each pocket has at least one movable wall member.

5. The feeder according to claim 1, wherein the opening drums are configured to operate synchronously with the pockets for grasping the sheets at a gripping edge thereof and for opening the pocket.

6. The feeder according to claim 1, wherein the conveying device is configured to supply the sheets to the pockets obliquely from below, horizontally or obliquely from above.

7. The feeder according to claim 1, wherein the opening device is configured to remove the sheets from the pockets obliquely downwardly, horizontally or obliquely upwardly.

8. The feeder according to claim 1, comprising a plurality of pulling-off drums each configured to remove sheets from a separate stack for feeding equal or unequal sheets to the pockets.

* * * * *